US006526591B2

(12) United States Patent
Leumi

(10) Patent No.: US 6,526,591 B2
(45) Date of Patent: Mar. 4, 2003

(54) REHABILITATION AND EXERCISE SYSTEM

(76) Inventor: Dov Leumi, 1744 Van Buren St., Hollywood, FL (US) 33020

( * ) Notice: Subject to any disclaimer, the term of this patent is extended or adjusted under 35 U.S.C. 154(b) by 0 days.

(21) Appl. No.: 09/909,323

(22) Filed: Jul. 20, 2001

(65) Prior Publication Data

US 2002/0046420 A1 Apr. 25, 2002

Related U.S. Application Data

(60) Provisional application No. 60/241,612, filed on Oct. 19, 2000.

(51) Int. Cl.[7] ..... A41D 19/00

(52) U.S. Cl. ..... 2/160; 2/159

(58) Field of Search ..... 2/16, 20, 158, 2/159, 160, 161.1, 161.2, 161.6, 161.7; 482/44, 47, 48, 49; 602/20, 21, 22, 62, 63

(56) References Cited

U.S. PATENT DOCUMENTS 4,587,673 A * 5/1986 Boliard ..... 2/159
4,665,565 A * 5/1987 Odom ..... 2/159
5,184,827 A * 2/1993 Suttle et al. ..... 2/161.3
5,203,763 A * 4/1993 Lajiness-O'Neill ..... 602/20
5,241,952 A * 9/1993 Ortiz ..... 434/261
5,768,710 A * 6/1998 Williams ..... 2/160
6,006,358 A * 12/1999 Keating ..... 2/161.1
RE36,778 E * 7/2000 DeLeo ..... 2/161.7
6,195,804 B1 * 3/2001 Fraser ..... 2/159
6,212,687 B1 * 4/2001 Kwon ..... 2/161.3

* cited by examiner

*Primary Examiner*—Gary L. Welch

(57) ABSTRACT

A pair of complimentary gloves that can be used in the self-help rehabilitation of a joint (e.g., shoulder) or an affected limb (e.g., arm) is herein disclosed. Each member of the pair of gloves includes indicia and a set of instructions through which the individual is guided as to the use and performance of exercise routines for rehabilitative extension and/or exercise of a effected joint or muscle. In one of the preferred embodiments of this invention, each digital portion of the glove is configured to permit the ends of the fingers to extend from the glove; and, a complimentary "hook and loop" array is affixed to each of the palm side and backhand side of each glove, respectively. This diversity of treatment in each such array permits a glove on one hand to couple with either the palm or backhand surface of the complimentary glove on the opposite hand, and thereby effect movement of the enabled hand/arm to extend and flex the disabled hand/arm.

5 Claims, 4 Drawing Sheets

REHABILITATION AND EXERCISE SYSTEM

This application claims benefit of provisional application 60/241,612 filed Oct. 19, 2000.

BACKGROUND OF THE INVENTION

1. Field of the Invention

This invention relates to an article of manufacture. More specifically, this invention relates to a device in the form of a complimentary pair of gloves that have been modified to permit one enabled arm of an individual to exercise a disabled arm of the same individual.

2. Background of Invention

Generally, debilitating injuries to muscles, joints and the spine can affect an individual's limb. Often, moderate to extensive rehabilitative care is needed to regain full use of the affected limb. Even if such rehabilitative care is available, the limited amount of time a therapist can devoted to an individual within a given therapy session is limited by both the resources available and the medical expense incidental to such care. One of the more problematic injuries sustained, and the rehabilitative care required for recuperation of full range of motion, is injury to one's shoulder.

Shoulders are the most movable, and one of the most fragile, joints in the human body. A shoulder has a range of motion that no other joint in the body comes even close to matching. It is the shoulders' flexibility that enables the arms to be useful in a variety of activities. Although the shoulder is an excellent positioner for the arm, it is not a good anchor. The shoulder's flexibility makes it prone to sudden injury and chronic wear and tear. Often someone with pain in the arm, hand, or neck may have trouble moving the shoulder. Likewise, shoulder pain can affect arm and hand movement. It is natural to react to shoulder pain by not moving the shoulder, which can result in almost total loss of the ability to move the shoulder at all. Fortunately, a doctor, sometimes with the aid of a physical therapist or occupational therapist, can almost always treat shoulder problems successfully, particularly if the patient follows a recommended exercise program designed to keep the shoulder in motion.

The shoulder is also very vulnerable to dysfunction following neurologic disease or trauma, such as a cerebral vascular accident (stroke) or traumatic brain injury. Following a stroke or head injury, patients frequently experience paralysis on one side of their body, referred to as hemiplegia. Prior to injury, the shoulder is one joint in our body which compromises stability for mobility. Following a stroke or head injury, the already unstable joint loses the muscular stability that maintains the joint integrity. As a result, the head of the humerus drops out of the glenoid fossa, resulting in what is known as a subluxed shoulder or subluxation. Furthermore, due to cortical damage, patients are frequently left with sensory impairments or substantial pain in this region.

Occupational therapists or physical therapists are the rehabilitation professionals to whom patients are referred by their physicians to treat these motor and sensory deficits. Treatment typically consists of specific neurodevelopmental techniques to facilitate normalized muscle tone, increase range of motion, decrease pain, and improve coordination and eventually strength. Before normal movement can be attained, the motor and sensory dysfunction, as well as the pain at the shoulder joint, must be treated. Typical treatment includes techniques such as weight bearing, joint approximation and proprioceptive input through the joint to increase muscular tone in order to decrease the joint separation (subluxation) and pain. Compensatory aids, such as static arm slings are sometimes used to help with positioning of the arm as rehabilitation progresses. However, these slings have not typically been therapeutic and are fraught with controversy as they place the arm in a bent and nonfunctional position. Furthermore, they typically facilitate spasticity, which is contraindicated for the hemiplegic arm.

While occupational and physical therapies are effective ways to treat symptoms of diseases, injuries, and disabilities of various types, they typically require an extremely long period of time before the patient reaches full or significant partial recovery. In part, this may be due to the short period of time spent in therapy, which typically may only be one hour a day. In most cases, it is only during this time period of occupational or physical therapy that the patient is properly exercising the necessary muscles in order to recuperate from the disease, injury or disability so that the patient can regain use of the affected limb or extremity. Therefore, it would be desirable in the present invention to increase the amount of time that a patient spends in therapeutic movements of the affected limb. In addition, it is desirable in the present invention to provide a patient with the ability to continue therapeutic movements throughout the day, even after leaving the supervision of the physical therapist, and more particularly, to have such therapeutic movements occur in response to normal every day activities or movements of a non-affected extremity.

The limited benefits available from abbreviated periods of physical therapy have not gone unappreciated and a number of devices have been proposed wherein the disabled individual is permitted to assist himself in his rehabilitation.

The following patents are representatives of such self-help rehabilitative devices:

U.S. Pat. No. 5,203,763 (to Lajiness-O'Neill, issued Apr. 20, 1993) discloses a dynamic sling or harness comprising an orthotic device which promotes glenohumeral joint integrity, normalization of muscular tone, and movement for patients with hemiparesis and hemiplegia following central nervous system dysfunction. Movement of the affected extremity is accomplished by active or passive shoulder flexion and/or horizontal adduction of the non-affected extremity from approximately 5 degrees to 90 degrees. Specifically, a cuff is worn on the non-affected extremity which attaches via webbing to a cable. Movement of the non-affected extremity activates a small and effective pull of approximately ¼" to ½" of the cable, which courses over a shoulder pad and through a cable guide attached to the shoulder ad by hook and loop material means, such as VELCRO. The cable eventually terminates onto a buckle which is attached by webbing to a neoprene cuff on the affected extremity. The Lajiness-O'Neill dynamic sling provides therapeutic benefit and aids patients with improved joint positioning through its dynamic and continuous mechanisms. The Lajiness-O'Neill device also enables the patient to provide continuous and intermittent joint approximation and proprioceptive sensory input to the hemiparetic or hemiplegic shoulder while wearing the dynamic sling.

U.S. Pat. No. 5,241,952 (to Ortiz, issued Sep. 7, 1993) discloses a therapeutic range-of-motion exercise device having a flat rectangular surface board with intersecting grooves routed into the top surface in patterns of, for example, a half circle, a straight line, and a straight line at a 45-degree angle. These patterns may vary from model to model in order to provide the user with progressively difficult patterns to increase rehabilitation benefits. The user places his hand into the hand guide, a flat hand-shaped device with a depression routed into the top surface for comfort, and a double set of hook and loop straps (Velcro) to secure the hand to the guide. A capped bolt protruding from the bottom of the guide slides into the grooves in the top surface of the board and the user pushes the handguide along these grooves, enabling him to stretch and rotate the arm and shoulder in a full range of motion. The range-of-motion board will accommodate the right or left arm of the patient.

U.S. Pat. No. 5,768,710 (to Williams, issued Jun. 23, 1998) discloses an exercise and rehabilitation device consisting of a weighted pair of gloves, each glove having a permanently affixed weighted section on the back-hand side of the glove and paired contoured weights which encircle the end of each individual finger and thumb sleeve. The digit sleeves are open ended to expose the individuals fingertips. A hook-and-pile attachment strip on the palm of the glove is operatively associated with a hook-and-pile covered cylindrical weight which can be detachably grasped by the wearer. A weighted wrist support strap detachably secures the glove to the individual's hand.

As is evident from the self-help therapy devices discussed above, each involves the user effecting movement of an impaired limb through some motion or movement of the unimpaired appendage. Such self-help movement is intended to improve range of motion or to restore/preserve muscle tone in the impaired appendage and joint. Notwithstanding such efforts, each of the prior art devices is relatively cumbersome, and/or requires multiple accessories and/or substantial dedicated space to house such accessories. Accordingly, there continues to exist a need for a simple yet effective self-help rehabilitation device that provides an individual having partial or localized impairment with the means to effectively improve range of motion of a joint and/or cause flexure of muscles without the assistance of another, and in an environment without additional accessories/supporting contrivance.

OBJECTS OF THE INVENTION

It is the object of this invention to remedy that above as well as related deficiencies in the prior art.

More specifically, it is the principal object of this invention to provide a pair of complimentary gloves wherein each member of such pair is capable of releasable coupling to the other.

It is another object of this invention to provide a pair of complimentary gloves that can be releasably coupled to one another at more than one position.

It is yet another object of this invention to provide a pair of complimentary gloves wherein each member of the complimentary pair includes indicia associated with each glove to assist in their cooperative use.

SUMMARY OF THE INVENTION

The above and related objects are achieved by a pair complimentary gloves that can be used in the self-help rehabilitation of a joint (e.g., shoulder) or an effected limb (e.g., arm). Each member of the pair of gloves includes indicia and a set of instructions in which the individual is guided as to how to use the gloves, and as to certain exercise routines for rehabilitative extension and/or exercise of an affected joint or muscle. In one of the preferred embodiments of this invention, each glove is configured to permit the ends of the fingers to extend from the palm; and, a complimentary "hook and loop" array affixed to each member of the glove pair, on each of the palm side and backhand side of each glove, respectively. More specifically, each pair of gloves includes a "hook" array on one member of each pair, and a "loop" array the other member of such pair. In the preferred embodiments of this invention, each of the palm and backhand surface of a single glove are treated the same, that is a single glove has either a "loop" or a "hook" array on its palm and backhand. This diversity of treatment in each array permits a glove on one hand to couple with either the palm or backhand surface of the complimentary glove on the opposite hand.

DETAILED DESCRIPTION OF INVENTION INCLUDING PREFERRED EMBODIMENTS

Figure 1:
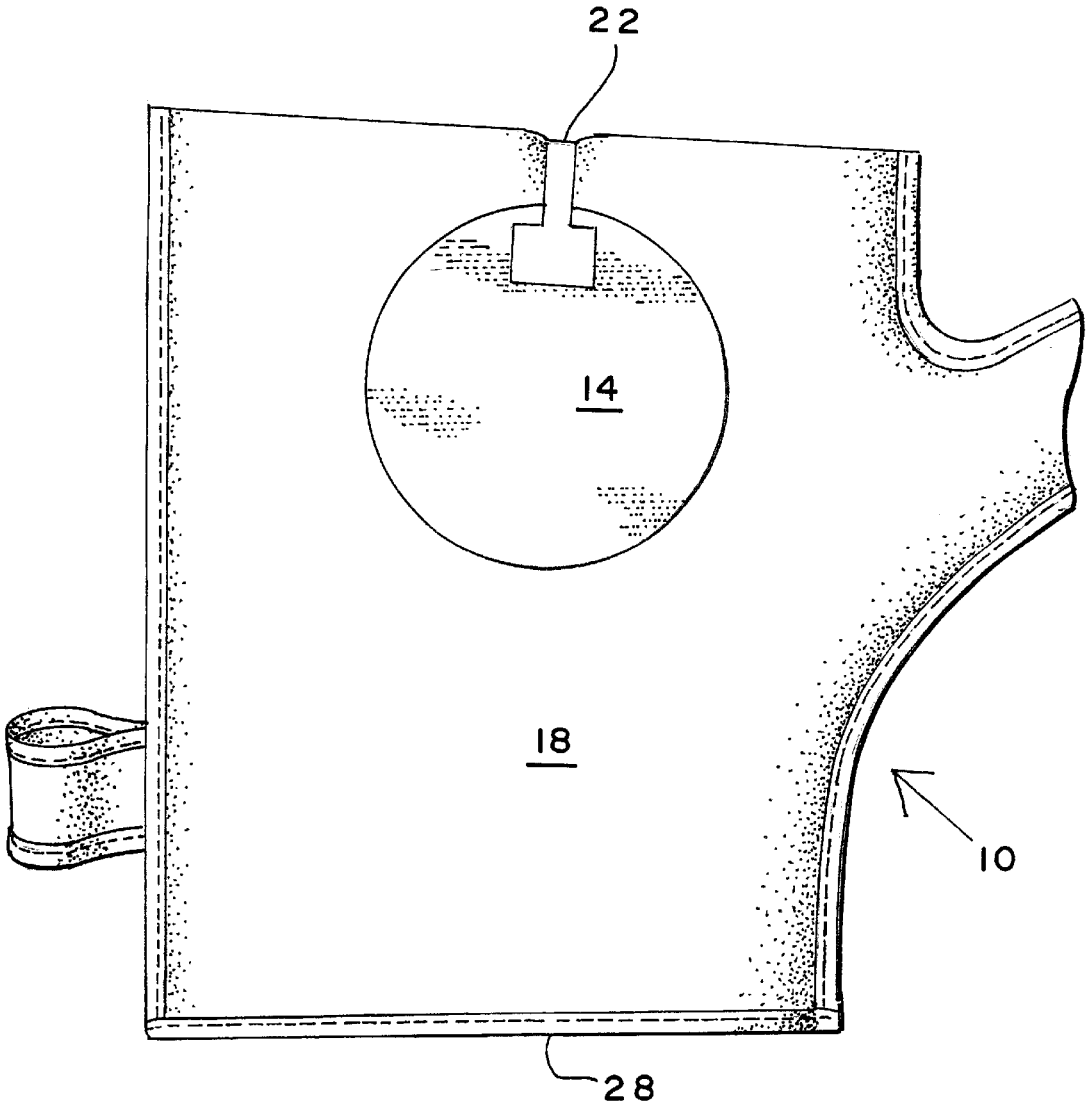
FIG. 1 is plan view of a first member of a pair of gloves of this invention, palm side up.
Figure 1A:
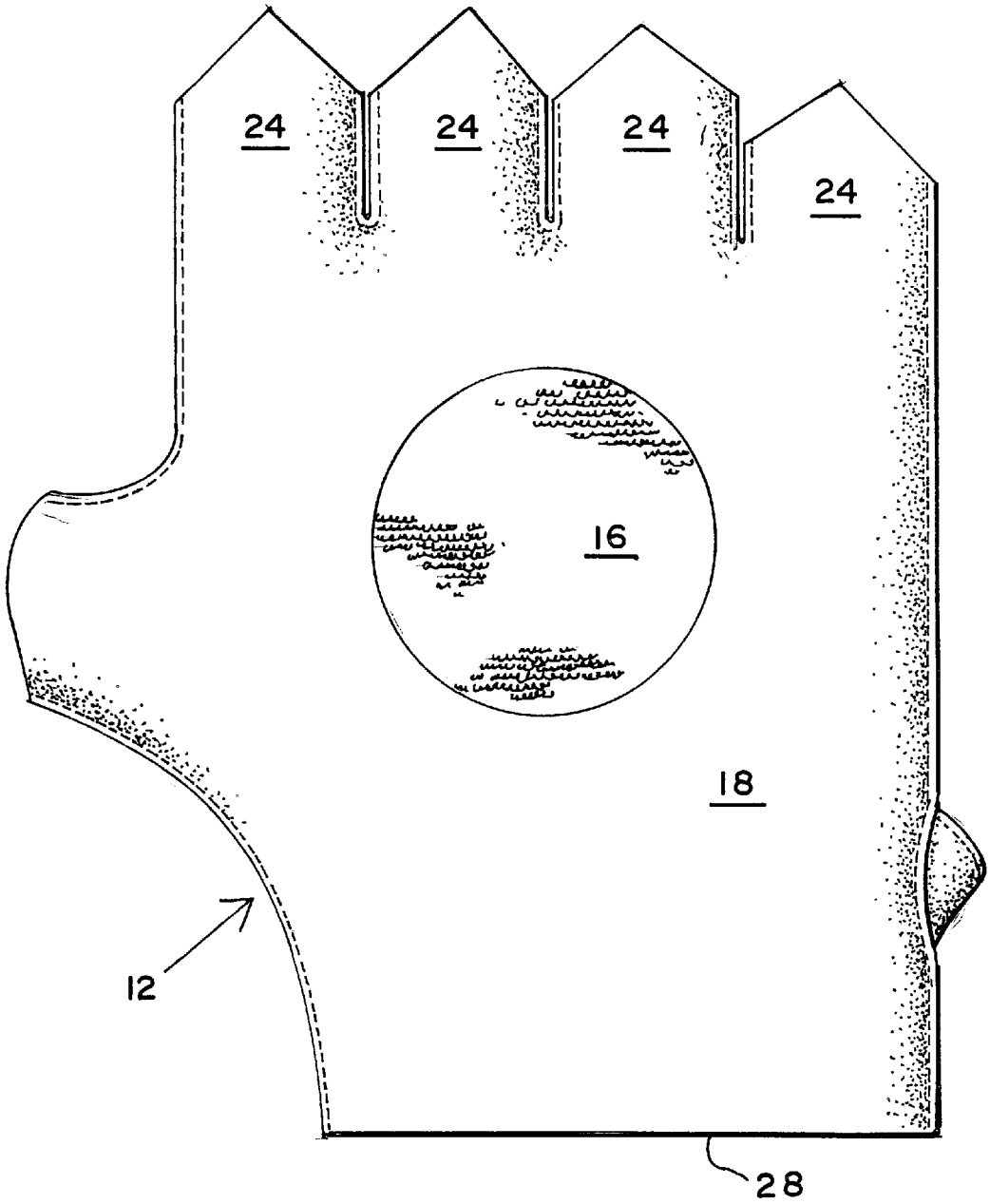
FIG. 1A is a plan view of a second member of a pair of gloves of this invention, palm side up.
Figure 2:
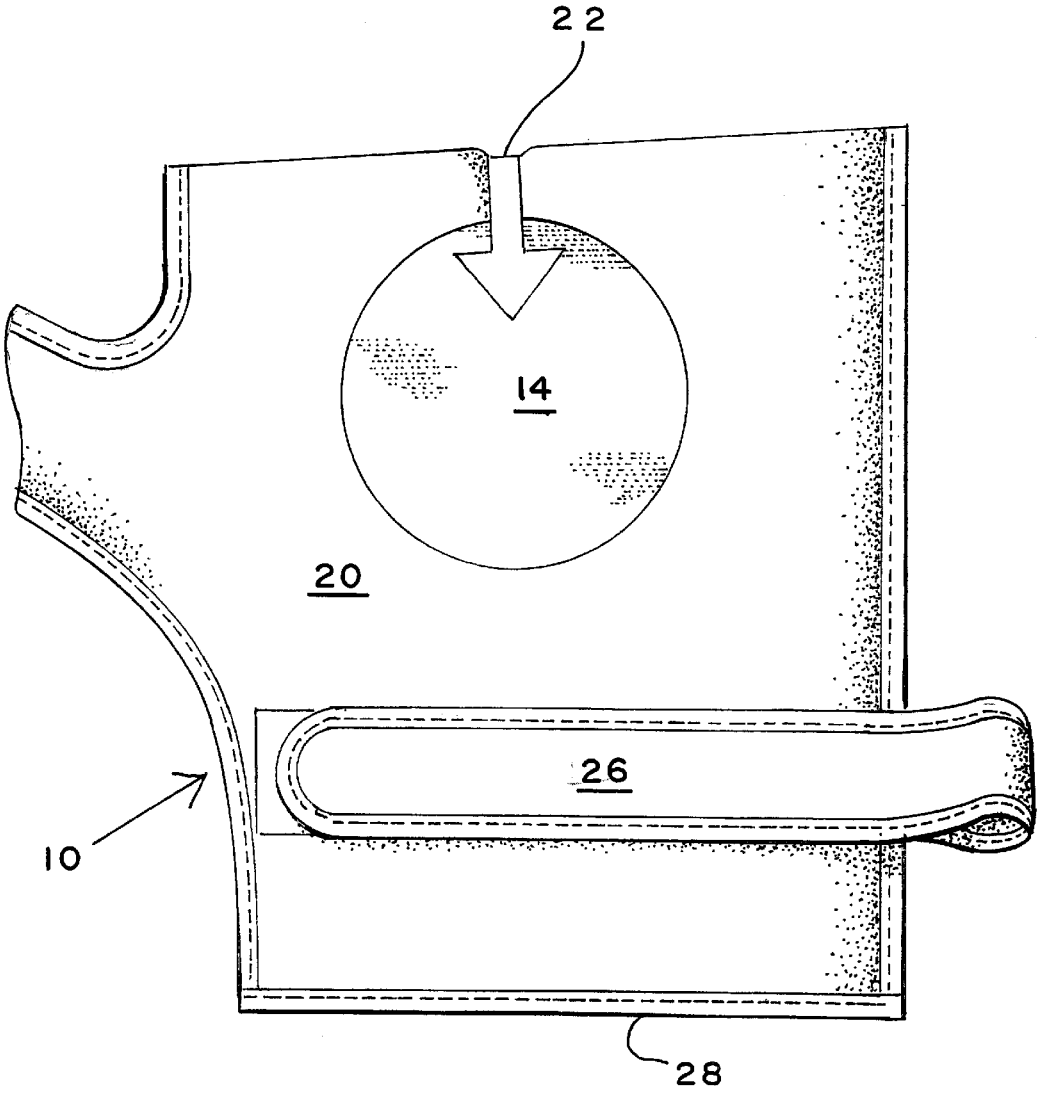
FIG. 2 is plan view of the first member of a pair of gloves of this invention, palm side down; and, FIG. 2A is a plan view of the second member of a pair of gloves of this invention, palm side down.
Figure 2A:
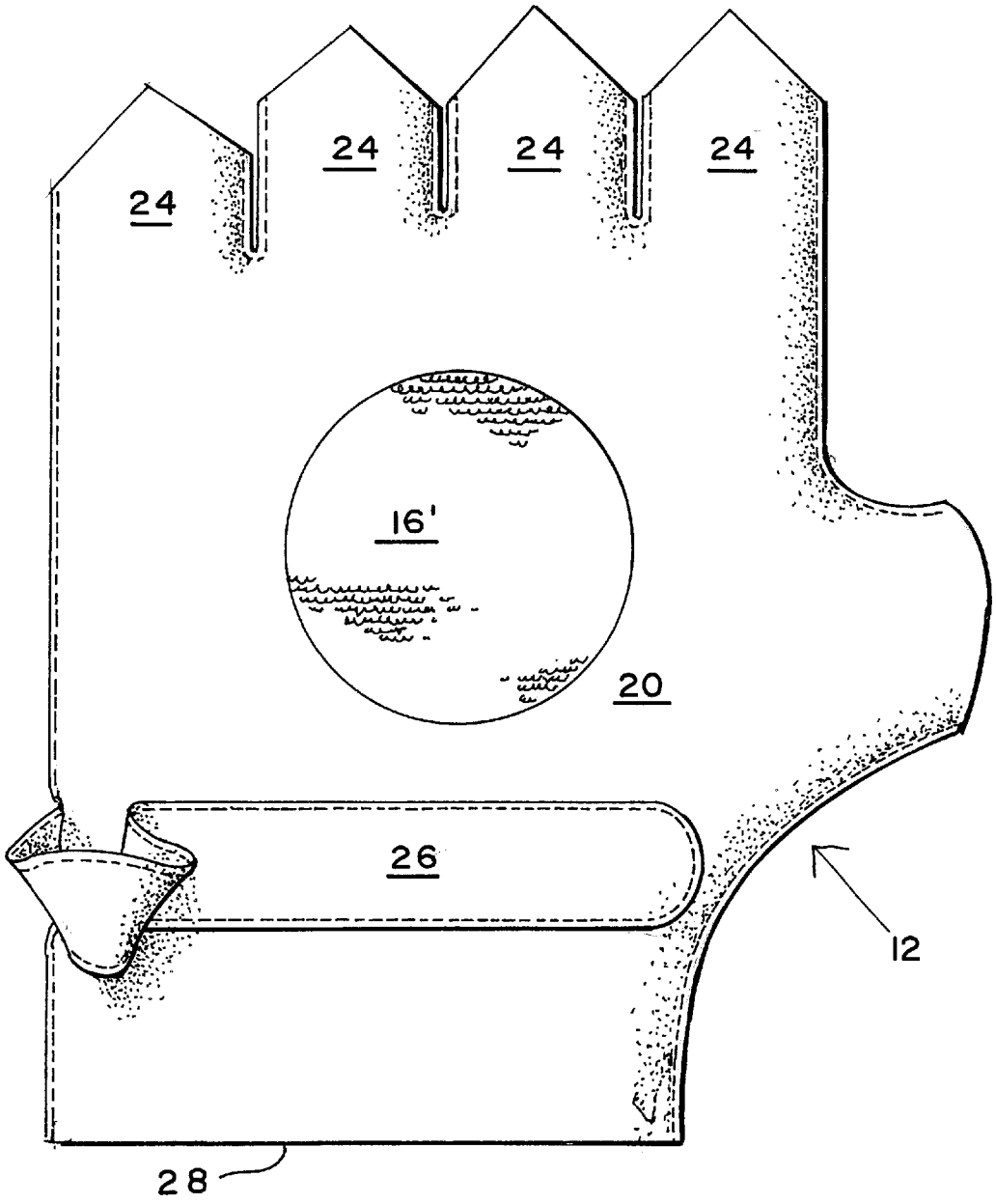

The figures which accompany this application, and referenced herein, depict representative embodiments of this invention. In the embodiments of this invention illustrated in these figures, elements in common to each are assigned a common reference numeral for ease of understanding and continuity of expression.

The self-help rehabilitation device of this invention is particularly suitable for rehabilitation of a shoulder injury, by permitting the enabled hand and arm to progressively extend and flex the disabled appendage, through a series of movements that are choreographed and controlled in accordance with the manner in which the glove on the enabled hand is coupled to the glove on the hand associated with the disabled joint or appendage. The objective of this choreographed and controlled movement of one hand by the other is to provide rehabilitative therapy in a manner that only the injured person can experience and modulate.

Common medical terms for describing shoulder movements include flexion, extension, abduction, adduction, external rotation and internal rotation. Shoulder flexion is the movement of raising the arm straight in front of the body over the head. Extension is the movement of moving the arm straight behind the body. Abduction is the movement of raising the arm out to the side over the head while keeping the arm straight. Horizontal adduction is the movement of raising the arm to shoulder height and bringing the arm out to the side, then in front of the body and out to the side again. Internal rotation is the movement of having the elbow bent and against the side of the body and moving the forearm as close to the stomach as possible. External rotation is the movement of having the elbow bent and against the side of the body and moving the forearm and hand from a position close to the stomach out to the side of the body.

Shoulder flexion and horizontal adduction are two of the most frequent movements performed with the functional, unaffected upper extremity, which is one reason for the successful facilitation of joint approximation and proprioceptive input for a hemiplegic shoulder. In addition, joint approximation and proprioceptive input are treatments of choice for a hemiplegic shoulder, therefore, continuous, self treatment with a pair of gloves of this invention assists with expediting treatment benefits, as well as lowering rehabilitative costs to a hemiplegic patient.

As shown in each of the FIGS. 1, 1 A, 2 and 2A, the self-help rehabilitative device of this invention comprises a pair of complimentary gloves (10, 12), one for each of the right hand and the left hand. In the embodiment of this invention, illustrated in the figures which accompany this application, each glove of the pair includes releasable means (14, 16) (e.g., Velcro Hooks & Loops) associated with the palm side (18) and the backhand surface (20) thereof, for coupling to either of the palm side (18) or backhand surface (20) of the other member of the complimentary pair.

In the embodiments of the invention illustrated in FIG. 1, the glove (10) is shown as having a simplified design wherein the digital portion thereof has been eliminated. The glove (10) is retained in position, relative to the palm (18), through a combination means, including retainer strap (22) at the open end of glove that extends forward over the open end of the glove and couples to the backhand surface (20) thereof. Alternatively, the complimentary member (12) of the glove pair includes a more traditional design wherein the ends of the digital extension (24) of the glove (12) have been clipped, thereby exposing the distal portions of each digit. In each instance, the gloves (10, 12) are further provided with a wrist strap (26) for confining the wrist opening (28) of the gloves (10, 12), and to, thus, further provide additional support for the gloves (10, 12) on each hand. Secure retention of each glove to each hand is critical to permit the enabled hand to effect extension and flexure of the joints and muscles of the disabled hand/arm.

In use, each glove is slipped over each hand so that the palm side of the glove corresponds to the palm side of the hand, and backhand side of the glove to the backhand side of the hand. In the preferred embodiments of this invention, the glove (10) having the open end (devoid of fingers) is place upon the disabled hand, and the glove (12) with the truncated digital portion on the enabled hand. The enabled hand is now place over the disabled hand so as to couple each of the arrays of hooks (14) and loops (16) in a specific alignment and thereby releasably couple one hand to the other. The enabled hand is moved by movement of the enabled arm. The movements of the enabled hand/arm cause corresponding extension and flexure of the joints and muscles of the disabled hand/arm. In the preferred embodiments of this invention, the alignment of the coupling means (14, 16) on one hand to the coupling means (14', 16') on the other hand is directed, (in accordance with a rehabilitation protocol), so as to orient the coupling of one hand to the other in a specific manner. The relative orientation of one hand to the other directly affects the motion to be imparted to the disabled hand/arm or the joint associated by the enabled hand/arm. Thus, in each instance, the relative orientation of one hand to the other is pre-set, in accordance with a rehabilitation objective, to effect the desired direction of movement of the disabled hand/arm.

In one of the preferred embodiments of this invention each of the gloves are provided with indicia (not shown) for alignment of the coupling of one glove to the other, and thereby properly position the gloves to effect the desired direction and range of motion to be imparted to the disabled hand/arm. These indicia can include alpha numeric symbols, color matching and the like.

The gloves and protocols associated therewith enables the administration of self-help rehabilitation to promote glenohumeral joint integrity, normalization of muscular tone, and movement for patients with hemiparesis and hemiplegia following central nervous system dysfunction.

Other objects, advantages and applications of the present invention will become apparent to those skilled in the art when the following description of the best mode contemplated for practicing the invention is read in conjunction with the accompanying drawings.

What is claimed is:

1. In a self-help rehabilitation device comprising an ensemble of complimentary components wherein means are attached to each band of an individual suffering a localized injury or incapacity relative to one side of his body so as to enable movement of one side of the individual's body to effect movement of an incapacitated limb or joint associated with an incapacitated limb, the improvement comprising:

A pair of complimentary gloves wherein each glove is configured to (a) fit an enabled hand and a disabled hand and (b) adapted for releasable coupling to one another via a complimentary array of "hook and loop" material affixed to each glove, said array of "hook and loop" material being affixed to each of said palm and backhand surfaces of each glove of said complimentary pair so as to permit releasable coupling of a palm of one member of said pair to either a palm or backhand surface of another member of said glove pair; and wherein said array of "hook" and "loop" material on each of said palm and backhand surface of each member of said pair of complimentary gloves is the same where one such glove of said complimentary pair is provided with an array of "hook" material and the other glove of said complimentary pair is provided with an array of "loop" material.

2. The improved self-help rehabilitation device of claim 1, where each member of said pair of gloves includes indicia which guide an individual in the use thereof to effect therapeutic exercise routines for rehabilitative extension or exercise of an affected joint or muscle.

3. The improved self-help rehabilitation device of claim 1, wherein at least one of said gloves of said member pair has an open digital end.

4. The improved self-help rehabilitation device of claim 1, wherein at least one of said gloves of said member pair has a digital end wherein the distal finger portion thereof has been removed.

5. The improved self-help rehabilitation device of claim 1, further comprising means for securely fastening each said glove to a wrist of each of said disabled hand and to said enabled hand, whereby upon coupling of one glove to another via complimentary array of "hook and loop" material, movement of a disabled hand is effected by movement of an enabled hand.

* * * * *